US005883602A

United States Patent [19]

Volman

[11] Patent Number: 5,883,602

[45] Date of Patent: Mar. 16, 1999

[54] WIDEBAND FLAT SHORT FOCI LENS ANTENNA

[75] Inventor: Vladimir Volman, Chevy Chase, Md.

[73] Assignee: Apti, Inc., Washington, D.C.

[21] Appl. No.: 937,288

[22] Filed: Sep. 15, 1997

Related U.S. Application Data

[63] Continuation of Ser. No. 464,213, Jun. 5, 1996, abandoned.

[51] Int. Cl.[6] ..... H01Q 19/10

[52] U.S. Cl. ..... 343/755; 343/756; 343/911 R

[58] Field of Search ..... 343/753, 754, 343/755, 756, 909, 911 L, 911 R, 786; H01Q 19/00, 19/06, 19/10

[56] References Cited

U.S. PATENT DOCUMENTS

| | | | |
|---|---|---|---|
| 3,331,073 | 7/1967 | Horst | 343/755 |
| 3,701,160 | 10/1972 | Beguin | 343/755 |
| 3,787,856 | 1/1974 | Pyrah | 343/755 |
| 3,820,116 | 6/1974 | Carlsson et al. | 343/756 |
| 4,220,957 | 9/1980 | Britt | 343/755 |
| 4,298,876 | 11/1981 | Crochet | 343/756 |
| 4,333,082 | 6/1982 | Susman | 343/754 |
| 4,504,835 | 3/1985 | Howard et al. | 343/755 |
| 4,977,407 | 12/1990 | Crane | 343/755 |
| 5,084,711 | 1/1992 | Moss et al. | 343/911 L |

FOREIGN PATENT DOCUMENTS

| | | | |
|---|---|---|---|
| 0056704 | 4/1980 | Japan | 343/755 |

*Primary Examiner*—Hoanganh Le
*Assistant Examiner*—Tan Ho
*Attorney, Agent, or Firm*—Rossi & Associates

[57] ABSTRACT

A wideband lens antenna lens of reduced thickness includes a lens antenna constructed of a flat inhomogeneous dielectric plate. A radiation source is located on one side of the dielectric plate and a reflector is located on another side of the dielectric plate opposite the radiation source. In operation, signals generated by the radiation source of arbitrary polarization pass through the dielectric plate, are reflected by the reflector, and pass back through the dielectric plate a second time before being emitted from the lens antenna. In such a case, the provision of the reflector allows the thickness of the dielectric plate to be cut in half as compared with conventional lens antennas. If the signals supplied by the radiation source are linearly polarized, a polarization transformer is provided on the same surface of the dielectric plate as the radiation source. In operation, the signals are reflected by the reflector back to the polarization transformer, which changes the polarization of the signals while reflecting them back through the dielectric plate. The change in polarization allows the signals to pass through the reflector and be emitted from the antenna structure. In such a case, the thickness of the dielectric plate can be reduced to one-fourth the thickness required in conventional lens antennas.

9 Claims, 8 Drawing Sheets

WIDEBAND FLAT SHORT FOCI LENS ANTENNA

This is a Continuation of application Ser. No. 08/464,213 filed Jun. 5, 1996, now abandoned.

FIELD OF THE INVENTION

The present invention relates to lens antennas constructed from inhomogeneous dielectric materials. More specifically, the invention relates to a lens antenna having a inhomogeneous dielectric lens of reduced thickness.

BACKGROUND OF THE INVENTION

Lens antennas could be utilized as receiving and transmitting antennas in many applications, but have many practical disadvantages including high weight, complex surface form and thickness that have limited their implementation. The problem of complex surface form can be addressed by forming the antenna lens from a flat piece of inhomogeneous dielectric material. While such lenses have certain unique features that cannot be achieved with lenses formed of a uniform dielectric, they do not solve the problems of weight and thickness associated with lens antennas.

A rectangular or circular slab of dielectric material has an index of refraction n(R) that is a function of radius as given by the following equation:

$$n(R)=n(\mathbf{0})\mathrm{sech}(\pi R/2F)$$

where n(0)>1 and F is a thickness of the lens which exhibits a focusing effect. The ratio F/D, where D is a diameter of the lens, is given by the equation:

$$F/D=(\pi/4)/\sinh^{-1}(1/n(\mathbf{0}))$$

For n(0)=2, the F/D ratio is equal to 0.544, which means that the lens thickness is more than half of the antenna diameter. Such an antenna structure would be to thick and heavy for most practical applications. While zoning could be used in an attempt to address problem of thickness and the associated problem of weight, the operating band of the antenna becomes narrower as the number of required zones increases, thereby rendering the antenna ineffective for many applications.

In view of the above, it is an object of the invention to provide a wideband lens antenna incorporating an antenna lens of reduced thickness. It is a further object of the invention to provide an antenna lens of simplified surface structure and reduced weight as compared with conventional antenna lenses.

SUMMARY OF THE INVENTION

The invention provides a wideband lens antenna incorporating a dielectric lens of reduced thickness. The antenna lens utilized in the lens antenna is preferably constructed of a flat inhomogeneous dielectric material or plate in order to simplify the surface structure of the lens. A radiation source is located on one side of the dielectric plate and a reflector is located on another side of the dielectric plate opposite the radiation source. In operation, signals generated by the radiation source having more arbitrary polarization pass through the dielectric plate, are reflected by the reflector, and pass back through the dielectric plate a second time before being emitted from the lens antenna. In such a structure, the provision of the reflector allows the thickness of the dielectric plate to be cut in half as compared with conventional lens antennas. The thickness of the dielectric plate can be further reduced if the signals supplied by the radiation source have linear polarization, by locating a polarization transformer on the same surface of the dielectric plate as the radiation source. In operation, the signals supplied by the radiation source are reflected by the reflector back to the polarization transformer, which changes the polarization of the signals while reflecting them back through the dielectric material a third time. The change in polarization allows the signals to pass through the reflector and be emitted from the antenna structure. In such a structure, the thickness of the dielectric plate is reduced to one-fourth the thickness required in conventional lens antennas.

BRIEF DESCRIPTION OF THE DRAWINGS

The invention will be described in greater detail with reference to the accompanying drawings, wherein.

DETAILED DESCRIPTION OF THE PREFERRED EMBODIMENTS

Figure 1:
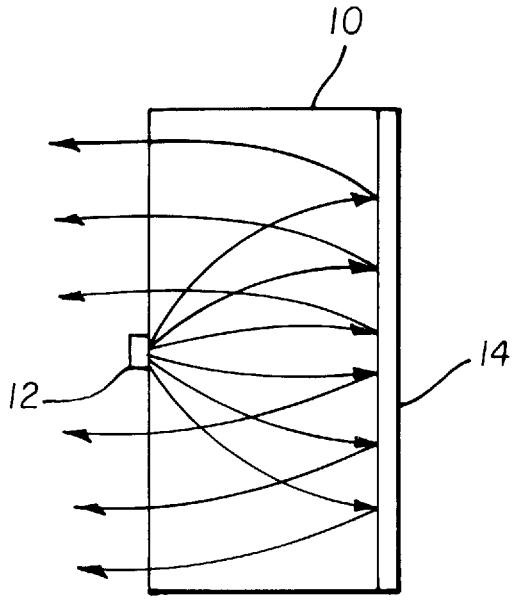
FIG. 1 is a side view of a lens antenna in accordance with a first embodiment of the invention.
Figure 2:
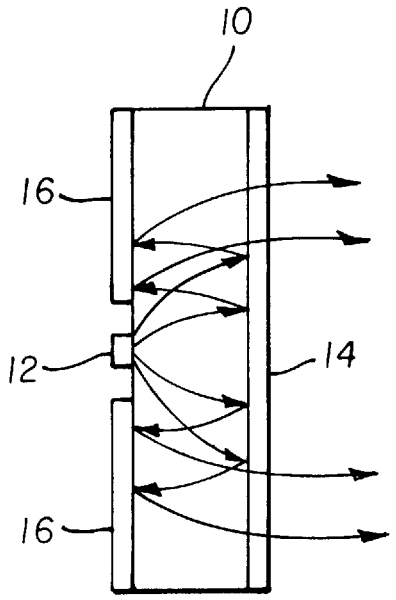
FIG. 2 is a side view of a lens antenna in accordance with a second embodiment of the invention.
Figure 3:
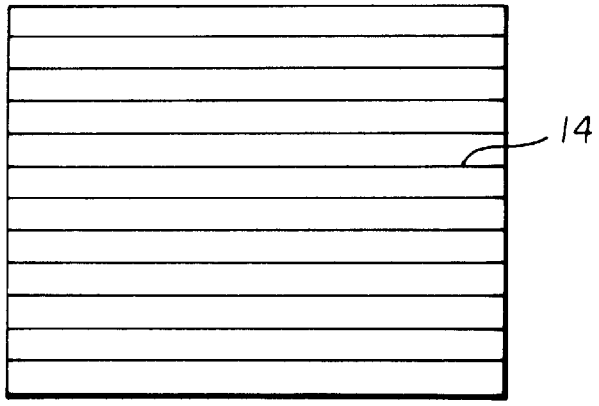
FIG. 3 is a front view of the lens antenna illustrated in FIG. 2 showing a reflector structure incorporated therein.
Figure 4:
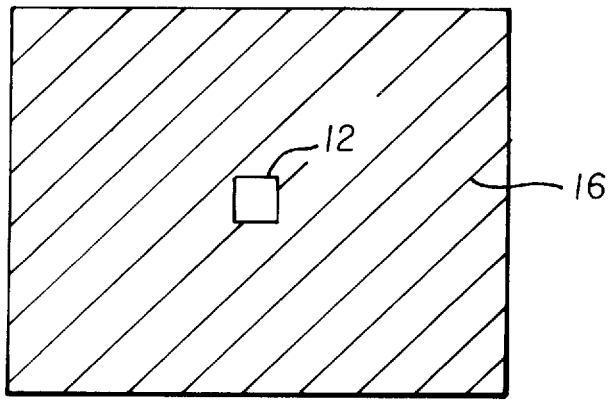
FIG. 4 is a back view of the lens antenna illustrated in FIG. 2 showing a polarization transformer incorporated therein.

A lens antenna according to the invention is illustrated in FIG. 1. The lens antenna includes a flat inhomogeneous dielectric lens 10 having a refractive coefficient that is dependent on radius or one of transverse coordinates (x- or y-coordinate). A radiation source 12, such as a feedhorn, semiconductor device, etc., is located at a first surface of the lens 10. A reflector 14 is located at a second surface of the lens 10 that is opposite the radiation source 12. In operation, a signal supplied by the radiation source 12 passes through the lens 10 and is reflected by the reflector 14. The reflected signal passes through the lens 10 a second time and is emitted from the antenna structure from the side of the lens on which the radiation source 12 is located. The thickness of the lens 10 is half the thickness of conventional lens antenna structures, due to the reflection of the signal by the reflector 14. The reduced thickness of the lens 10 directly translates into reduced weight for the antenna structure. The reflector 14 may include a flat metal plate or grid that reflects the signal supplied by the radiation source 12 regardless of polarization. If the signal supplied by the radiation source 12 has linear polarization, however, it is possible to further reduce the thickness of the lens 10 by forming the reflector 12 such that it reflects only signals having the same polarization as those supplied by the radiation source 12. A polarization transformer 16 is then added to the side of the lens 10 containing the radiation source 12 as shown in FIG. 2. In such a case, signals generated by the radiation source 12 are reflected by the reflector 14 back to the polarization transformer 16, which in turn changes the polarization of the signals and reflects them back toward the reflector 14. Due to the polarization change, however, the signals now pass through the reflector 14 and are emitted from the antenna structure from the side of the lens on which the reflector 14 is located. As shown respectively in FIGS. 3 and 4, the reflector 14 and the polarization transformer 16 may consist of a series of metal lines that are at an angle to one another, with the lines of the reflector 14 being in conformance with the polarization of the signals generated by the radiation source 12. In this case, the thickness of the lens 10 is reduced to one-fourth the thickness of conventional lens antennas due to the multiple reflections between the reflector 14 and the polarization transformer 16.

Figure 5:
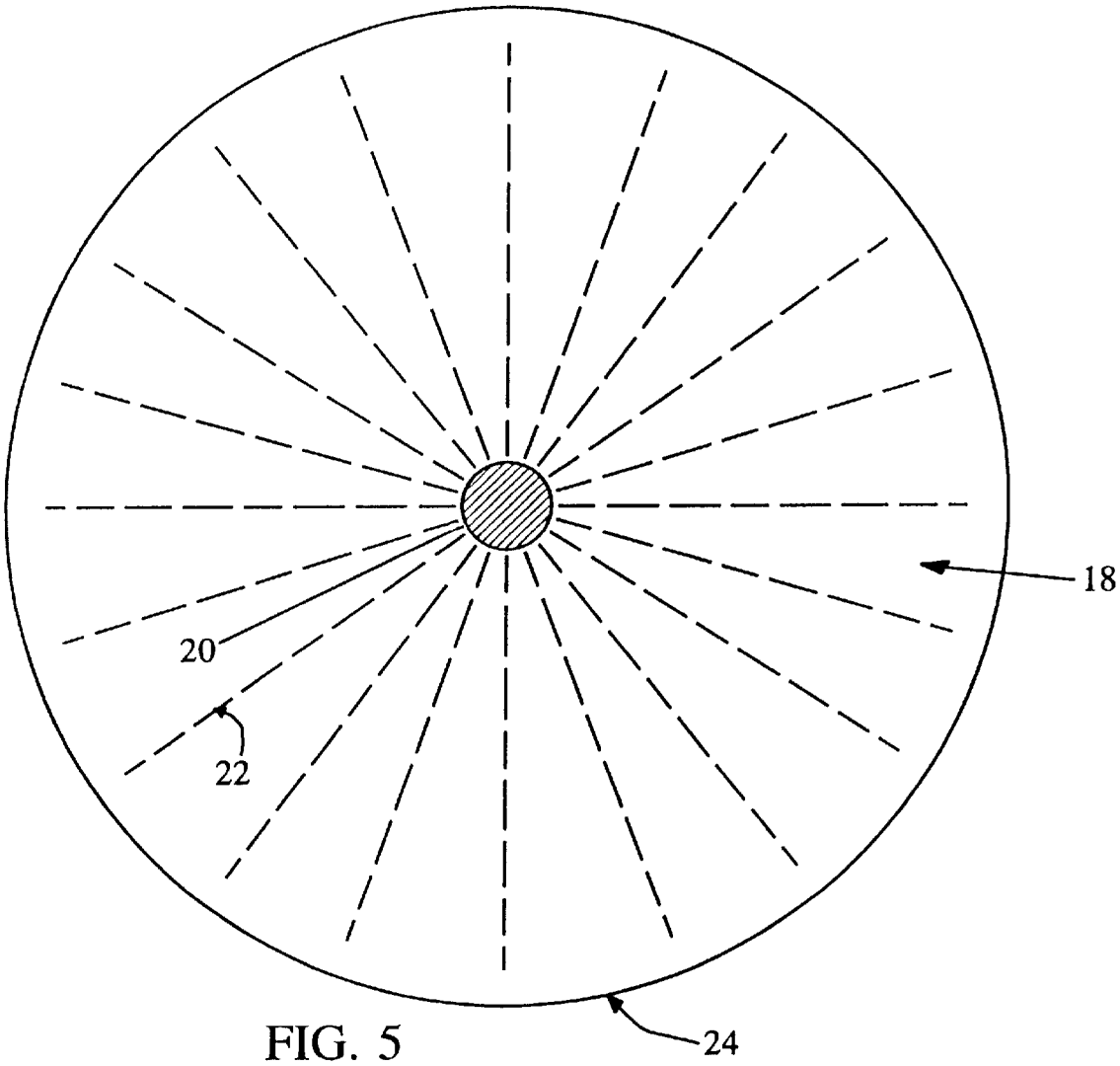
FIG. 5 illustrates a disc containing a metallized pattern which was used to create an artificial inhomogeneous dielectric.
Figure 6:
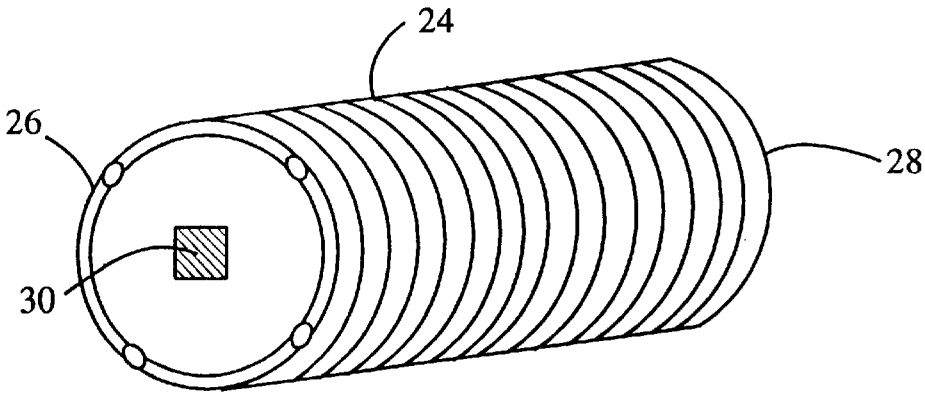
FIG. 6 illustrates one possible experimental lens antenna structure in accordance with the invention.
Figure 7:
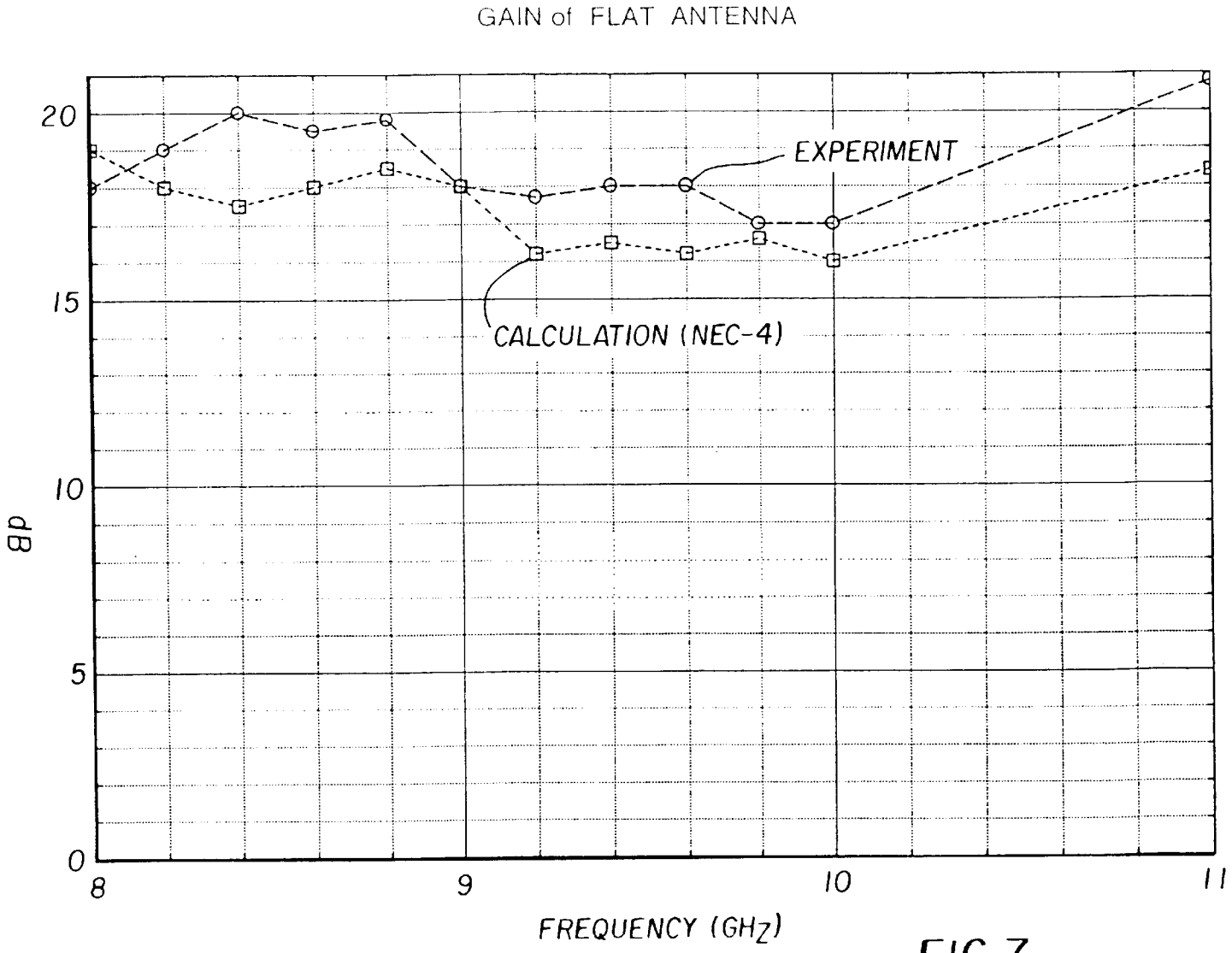
FIGS. 7–10 are graphs illustrating the performance of the experimental lens antenna illustrated in FIG. 6.
Figure 8:
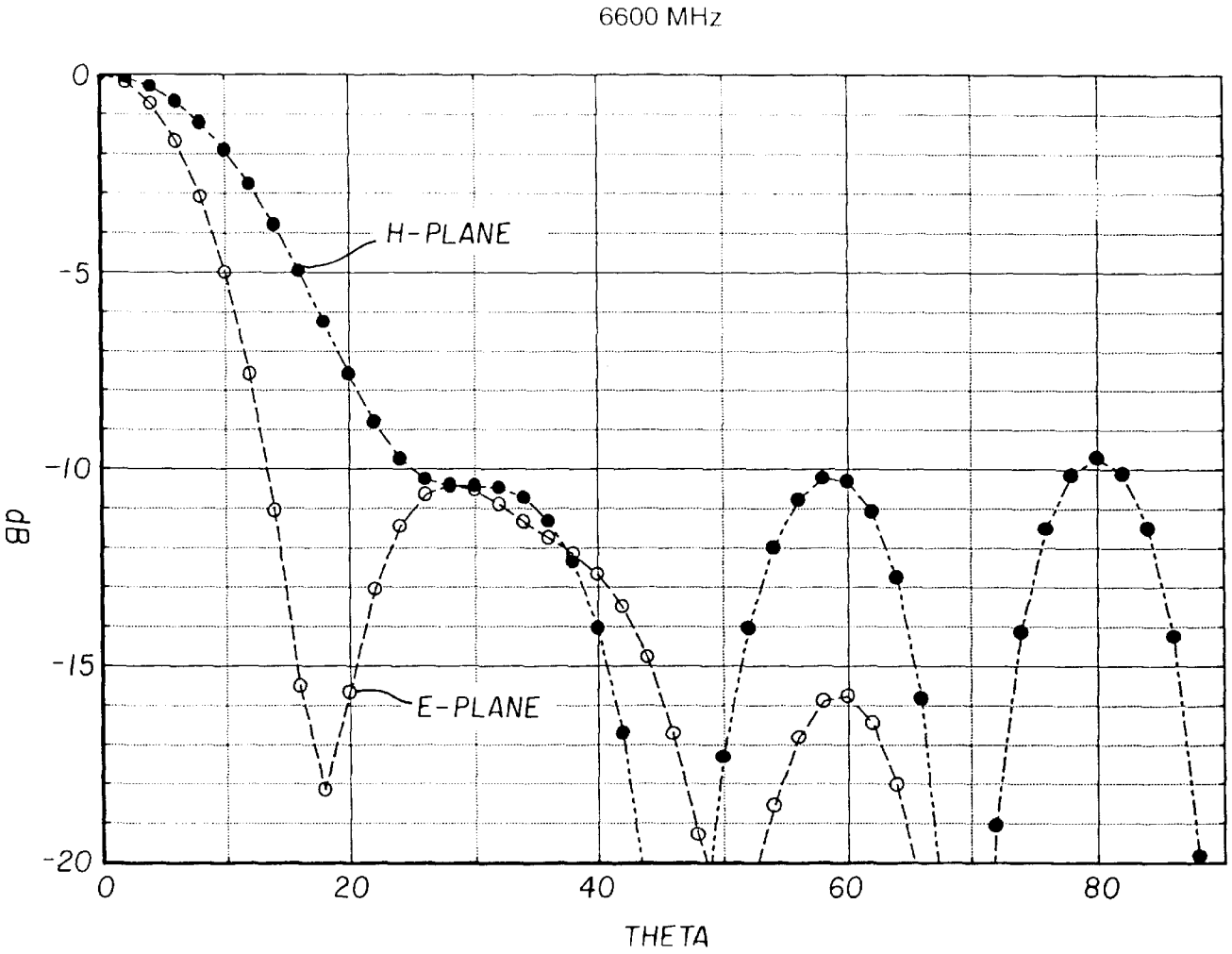
Figure 9:
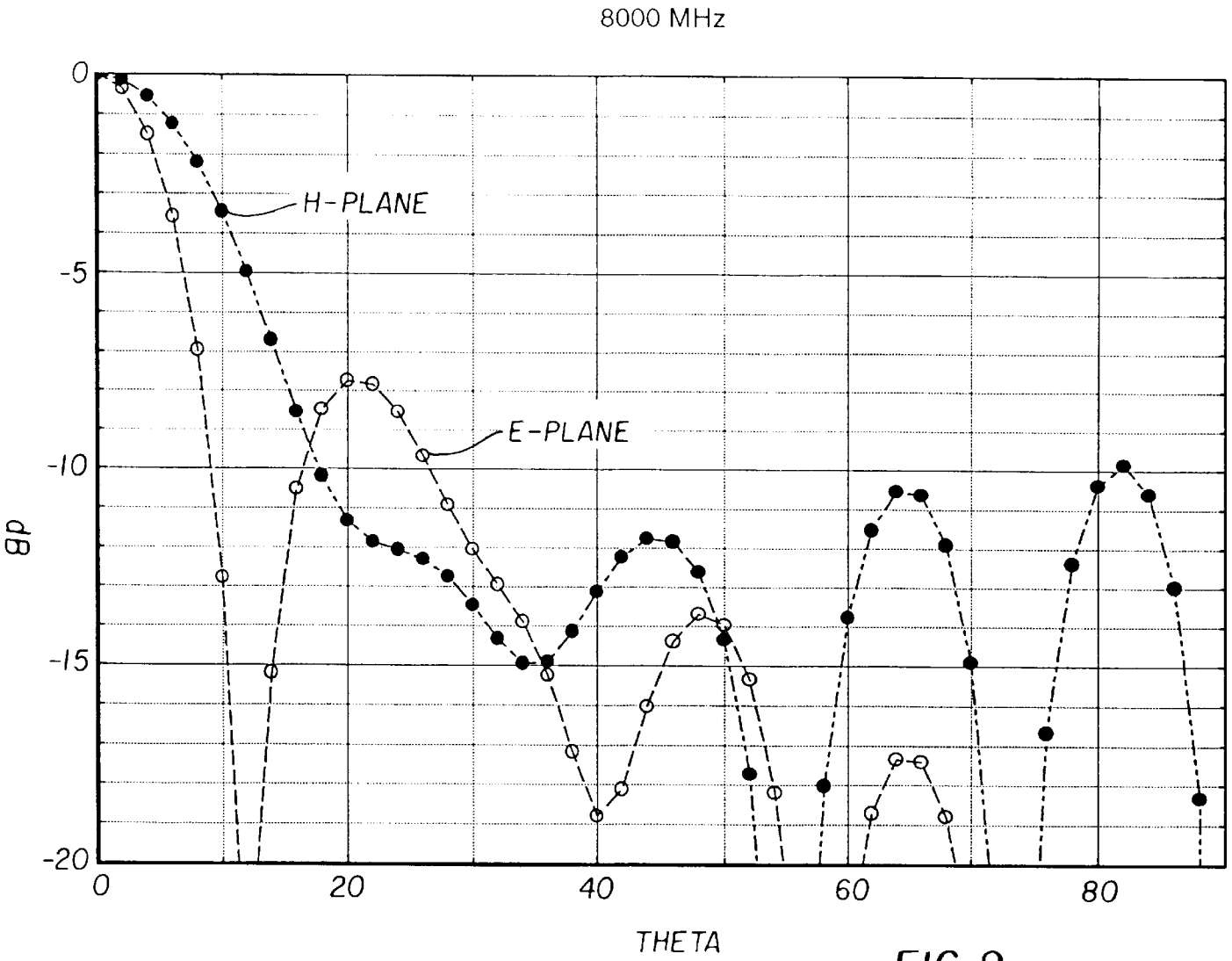
Figure 10:
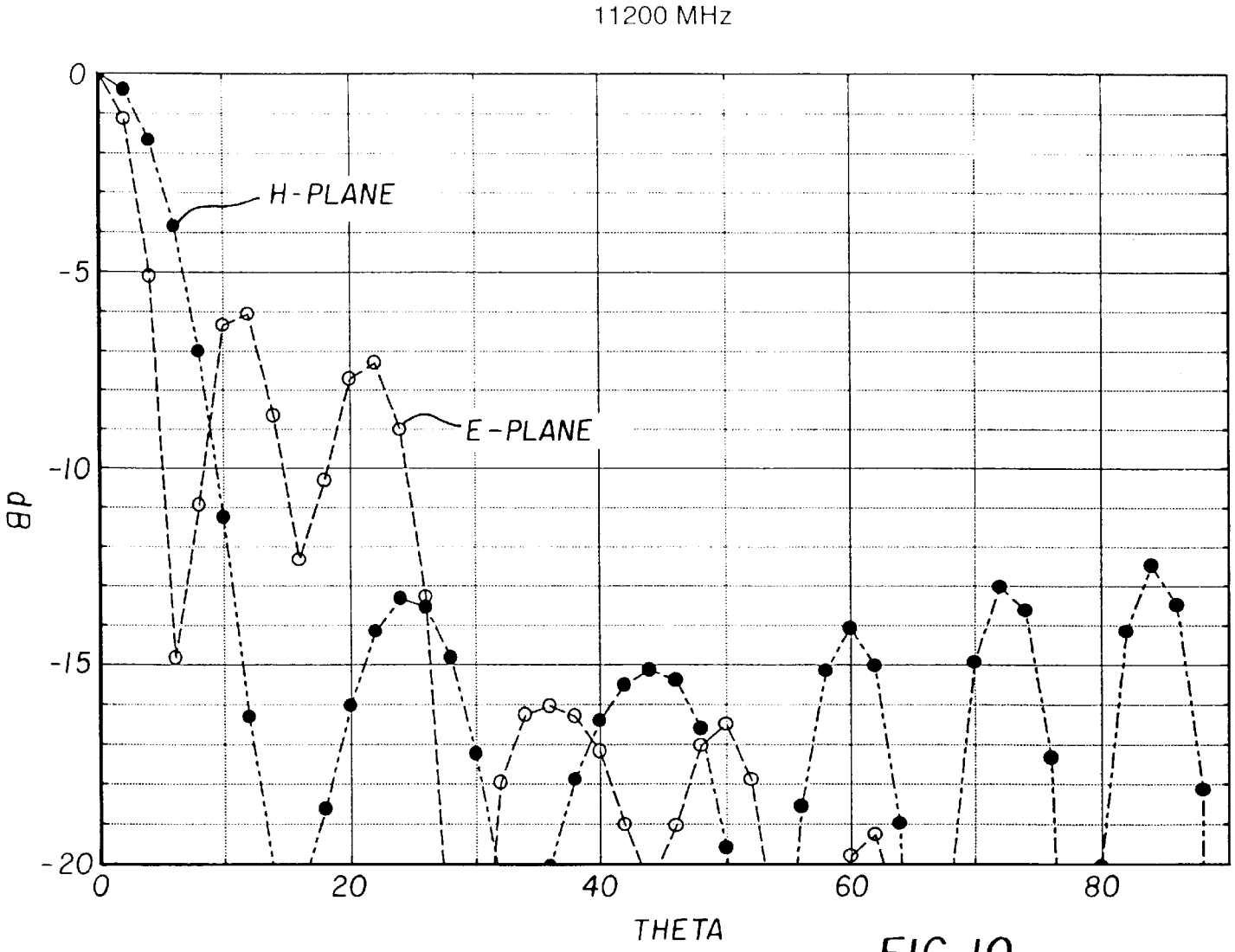

In order to test the operation of the inventive lens antenna, an experimental antenna structure was constructed utilizing an artificial inhomogeneous dielectric. As will be readily appreciated by those of ordinary skill in the art, an artificial inhomogeneous dielectric can be constructed by providing a reflective pattern on multiple layers of a homogenous dielectric. FIG. 5 illustrates a pattern 18 utilized in the experimental antenna structure that incorporates a central metal disc 20 with extending broken metal wires 22 of decreasing length. The pattern 18 was formed on a Styrofoam disc 24 having a diameter of 20 cm and a thickness of 4 mm. Sixteen of the discs 24 were then bolted together between a retaining ring 26 and a metal disc reflector 28. A feed horn 30 was then secured to the combined disk structure on the side opposite the metal disc reflector 28 as shown in FIG. 6. FIGS. 7–10 illustrate the performance of the experimental antenna structure at different operating frequencies.

Figure 11:
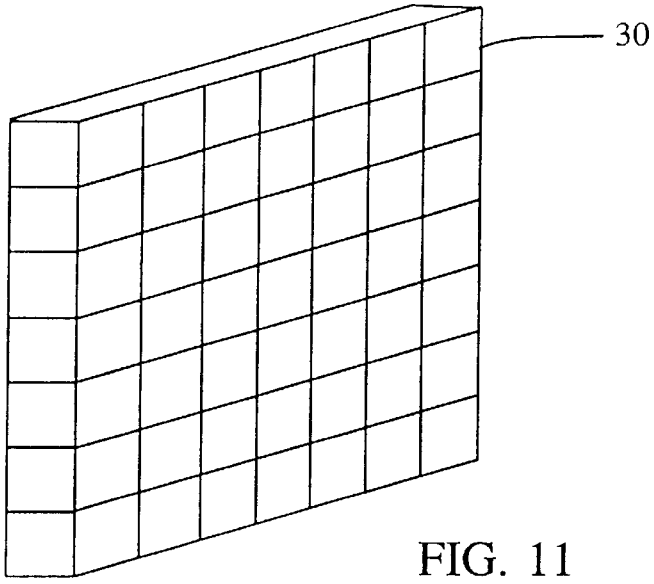
FIG. 11 illustrates an array of antenna elements of the types illustrated in FIG. 1 or FIG. 2.
Figure 12:
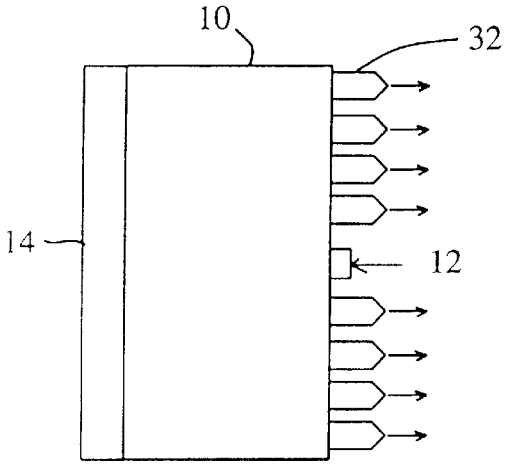
FIG. 12 illustrates a structure for supplying signals from a central radiation source to a plurality of radiation receivers.
Figure 13:
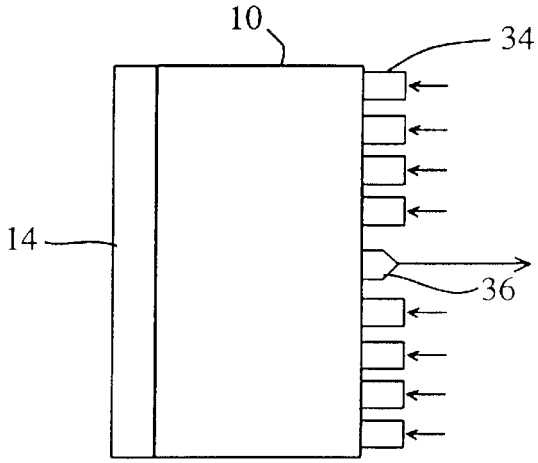
FIG. 13 illustrates a structure for receiving signals from a plurality of radiation sources with a centrally located receiver.

The lens structure of the present invention can be readily incorporated into microwave broadcast and communication systems, including portable satellite telephone and broadcast satellite stations. In quasi-optical, passive or active arrays, it may be desirable to form an array of lens antenna elements 30 as illustrated in FIG. 11, wherein each lens antenna element 30 consists of a lens antenna of the type illustrated in either FIGS. 1 or 2 above. In addition, the lens antenna structure can be utilized in wide band dividers to distribute signals, by providing a plurality of radiation receivers 32 on the same side of the lens 10 to receive signals supplied from a centrally located radiation source 12 as shown in FIG. 12. Alternatively, the radiation receivers 32 and the central radiation source 12 can be replaced by a plurality of radiation sources 34 and a central receiver 36 as illustrated in FIG. 13, in which case the signals from the radiation sources would be combined by the central receiver 36.

The invention has been described with reference to certain preferred embodiments thereof. It will be understood, however, that modifications and variations are possible within the scope of the appended claims. For example, the materials and patterns used to create the reflector and polarization transformer may be readily varied.

What is claimed is:

1. An antenna structure comprising: a dielectric lens including a substantially flat first surface and a substantially flat second surface, which is substantially parallel to the first surface, and having a refractive coefficient dependent on radius; at least one radiation source located at the first surface of the dielectric lens; and a reflector located at on the second surface of the dielectric lens opposite said first surface.

2. An antenna structure as claimed in claim 1, further comprising a polarization transformer located at the first surface of the dielectric lens.

3. An antenna structure as claimed claim 2, wherein the radiation source generates linearly polarized signals, the reflector reflects the linearly polarized signals, the polarization transformer changes the linearly polarized signals to orthogonally polarized signals, and the reflector passes the orthogonally polarized signals.

4. An antenna structure as claimed in claim 3, wherein the polarization transformer is a pattern of metal lines and the reflector is a pattern of metal lines at an angle with respect to the pattern of metal lines of the polarization transformer.

5. An antenna structure as claimed in claim 1, wherein the reflector is a metal plate.

6. An antenna structure as claimed in claim 1, wherein the reflector is a pattern of metal lines.

7. An antenna structure as claimed in claim 1, wherein the dielectric lens comprises an inhomogeneous dielectric material.

8. An antenna structure as claimed in claim 1, wherein the dielectric lens comprises an artificial inhomogeneous dielectric material.

9. An antenna structure as claimed in claim 1, further comprising at least one radiation receiver located at the first surface of the dielectric lens.

* * * * *